US006117019A

United States Patent [19]

Taylor

[11] Patent Number: 6,117,019

[45] Date of Patent: Sep. 12, 2000

[54] ENGLISH AND TRAJECTORY ASSISTANT

[76] Inventor: Steven Scott Taylor, 135 Liberty La., Indian Trail, N.C. 28079

[21] Appl. No.: 09/197,790

[22] Filed: Nov. 23, 1998

[51] Int. Cl.[7] ..... A63D 15/08

[52] U.S. Cl. ..... 473/46; 473/44; 473/49; 473/2

[58] Field of Search ..... 473/44–49, 51, 473/2, 209

[56] References Cited

U.S. PATENT DOCUMENTS

| | | | |
|---|---|---|---|
| 4,688,796 | 8/1987 | Wright | 473/44 |
| 5,181,718 | 1/1993 | Valentine | 473/45 |
| 5,275,398 | 1/1994 | Compton | 473/45 |
| 5,554,075 | 9/1996 | Glazer | 473/46 |
| 5,738,595 | 4/1998 | Carney | 473/209 |

*Primary Examiner*—Mark S. Graham

[57] ABSTRACT

The english and trajectory assistant is a device to aid a player of ball and pocket games to properly strike his primary target ball, resulting in a favorable shot. The device is an attachment which can be fastened to any existing playing stick. The assistant simultaneously projects cross hairs onto the primary and secondary target balls without moving the stick from the shooting position. The device is easily removed and replaced with a traditional stick end. The tip is easily replaced by being unscrewed. Shape, balance, and weight of the stick are not altered. The assistant is able to remain energized without any intentional contact by the player, which could detrimentally affect his performance

14 Claims, 4 Drawing Sheets

ENGLISH AND TRAJECTORY ASSISTANT

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

1. Field of the Invention

The present invention relates to laser pointers, and more particularly to an attachment for billiard cues that shows a player the point at which to strike the cue ball to make their intended shot.

2. Description of Prior Art

The various billiards games are all difficult by nature. It is easily understood why the game of billiards is the subject of more patents than any other sport with the exception of golf. There are many factors working against a pool player, most of which must be overcome by sheer talent and experience, although some devices have allowed players to improve their chances of overcoming these obstacles.

The two chief elements of a good pool shot are the trajectory upon which the cue ball is launched, and the position in which the cue ball stops. A cue ball projected in the wrong direction will not result in the object ball entering the target pocket. A cue ball not coming to rest in the position desired by the player may not allow a second successful shot, or, in worse cases, may result in a 'scratch', a most unfavorable condition. The final resting position, or 'lie' of the cue ball is determined by the point upon said cue ball where it has been struck. Manipulating the cue ball so as to affect its final resting position is known as "applying english" to the ball.

There have been scores of patents that have enterprised to increase the likelihood of a player projecting the cue ball in the right direction. For instance, there is U.S. Pat. No. 5,338,262, where Hayes attempts to solve the problem by making a mark on the rail of a pool table to visually indicate a point toward which the cue ball should be launched. This invention assumes that the player will accurately strike the ball. If the cue ball is not struck in the proper position, the device by Hayes is worthless.

In U.S. Pat. No. 5,554,075, Glazer attempts to solve this by means of a laser, but his device requires fastening parts to the side of the player's cue which will result in imbalance, not to mention an increase in the weight of the cue stick. The proper balance and weight of a cue stick define its quality and utility. Furthermore, Glazer's device does not project a beam strictly parallel and collinear to the cue stick. This would result in misleading information from the laser image.

Wright, in U.S. Pat. No. 4,688,796, also proposes a laser sight to aid the player. However, the simple spot projected by the laser does not provide the player with any information on the angle in which to hold his stick. Simply hitting the cue ball in a particular spot does not ensure it will travel in the intended direction. To launch the cue accurately, there must be a correct combination of the strike position and strike angle. In an attempt to solve this, Wright suggests raising one or more ends of the stick to allow the beam to strike the cue ball first, and then the target ball. This requires changing the position of the stick, and ultimately coming to rest in a position that does not inform the player of the proper stick angle. Another problem of the Wright pool cue is the fact that the player must use a quite complex cue stick, designed and built around this patent. The avid pool player tends to become attached to their own favorite cue, and there would be no way to retrofit it with the Wright design. Furthermore, the complexity of the design are such that it would be impractical to ever build.

Carney, in U.S. Pat. No. 5,738,595, has also endeavored to solve the problem with a laser pointer, but his device suffers from the same problems as Glazer and Wright, particularly the balance and cue stick angle problems.

There have been numerous utility and design patents for laser pointers, including U.S. Pat. No. 5,268,820, Lo, and U.S. Pat. No. 5,697,700, Huang, but these designs do not have any references to potential applications as attachments to billiard cues, or as sights for billiard cues.

BRIEF SUMMARY OF THE INVENTION

The invention, the english and trajectory assistant, is an attachment that enables a pool player to easily and accurately determine the precise point upon which to strike a cue ball, and the precise angle to hold the cue stick, to effect the desired shot. The invention solves many problems which plagued past devices.

The present invention is a short attachment to the striking-end of a pool cue that houses a laser module, cross hairs-generating optics, a sustained-contact switch, a power source, a removable leather-topped cue tip assembly, and an attachable traditional wooden cue end.

The assistant overcomes the problem of Hayes by ensuring that the player is provided with enough information to determine where to strike the cue ball to achieve the results desired. The cross hairs projected from the laser are displayed on the cue ball and either the target ball or the rail of the pool table. Given that two points define a line, a player may easily, by sighting along the cue stick in the traditional way, position his stick collinear with the line defined by the laser image on the two targets.

Glazer's device had the drawbacks of disturbing the balance and weight of the pool cue, not to mention the clumsiness of external attachments. Also, the non-collinear beam of Glazer's device provides misinformation to the player. The present invention replaces a portion of the cue stick, resulting in an enhanced stick of the exact shape, weight, and balance characteristics. The invention also does not increase the risk of damage to the pool table resulting from attachments to the side of the cue shaft. One can easily see how a small mistake by the player using Glazer's device could result in torn table felt. Furthermore, the present invention generates a beam collinear to the cue stick.

Although the device by Wright has its merits, the problems of a single-spot sight, stick complexity, and lack of retrofit ability remain. The present invention allows the cue stick to be properly aligned to the cue ball without having to move it out of the shooting position. One can visualize the proper aim up until the time the cue ball has been struck. The simplicity of the design of the invention allow it to be commercially viable. Also, it can be mounted on any cue stick of any player, allowing them to upgrade the cue stick of their choice.

The invention solves Carney's weight, balance, and aiming limitations in the same manner it overcomes the problems of Glazer and Wright.

The laser pointers designed by Huang, Lo, and others have been improved by replacing the traditional momentary-on pushbutton with a sustained-contact switch. Furthermore, the invention solves the problem of mounting the laser to a cue stick without altering the shape or performance of said cue stick.

Through innovative design, the english and trajectory assistant overcomes all previous problems relating to aiming a pool shot. Without disturbing the balance, weight, or shape of the player's preferred pool cue, the invention provides the player with accurate visual indication of the angle to hold the stick and the spot the cue will be struck to properly effect the desired shot. Actually enforcing the player to properly perform this shot is beyond the scope of the invention.

DETAILED DESCRIPTION OF THE INVENTION

Figure 1:
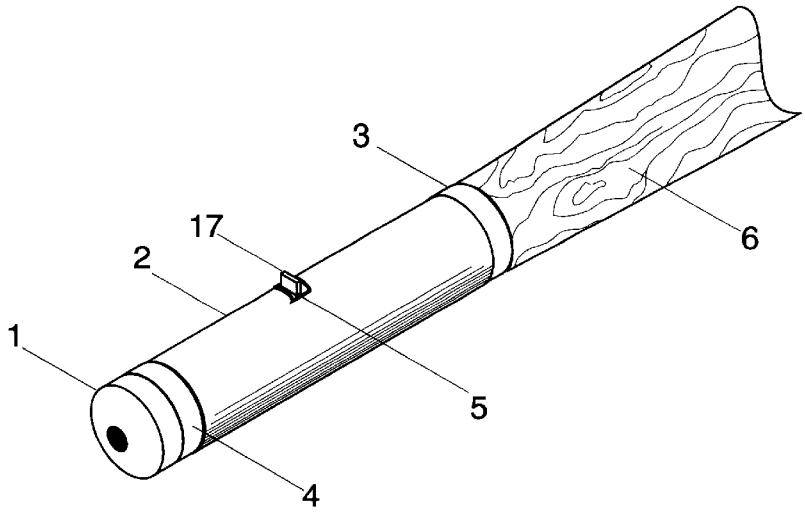
FIG. 1 is an elevational view of an english and trajectory assistant according to the preferred embodiment of the present invention.
Figure 2:
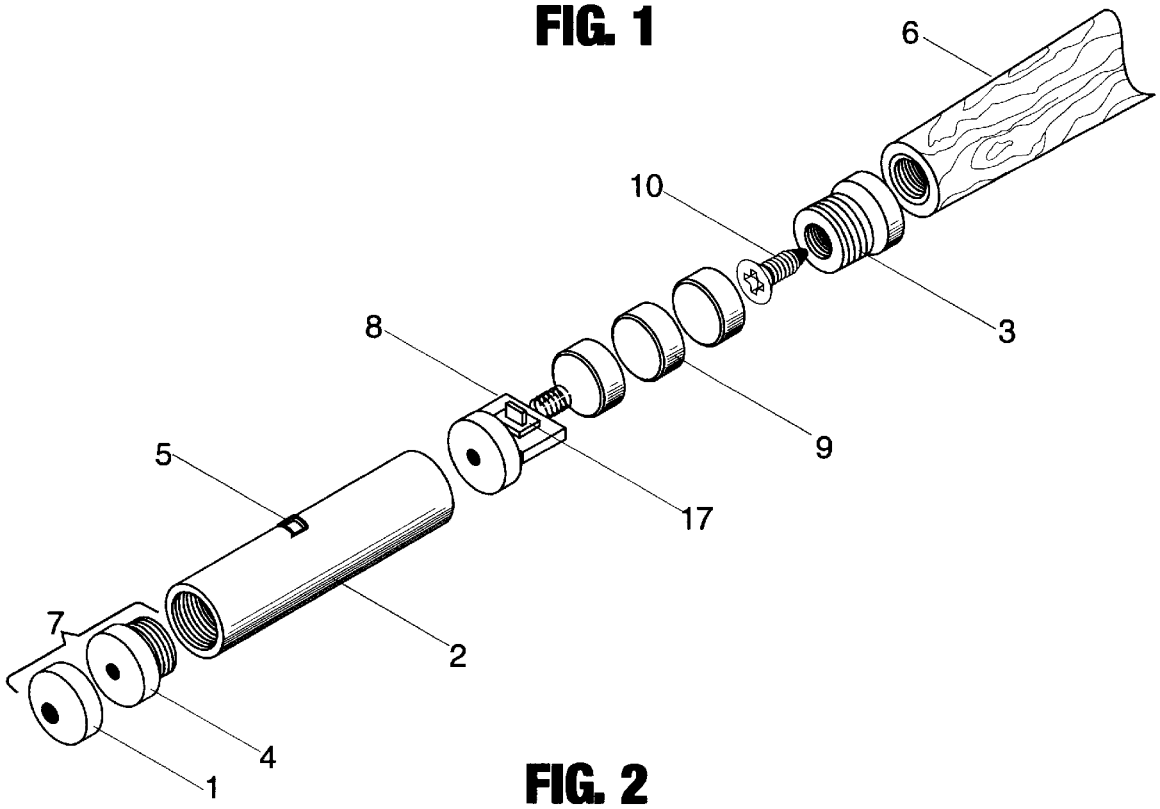
FIG. 2 is an exploded view of the english and trajectory assistant shown in FIG. 1.
Figure 3:
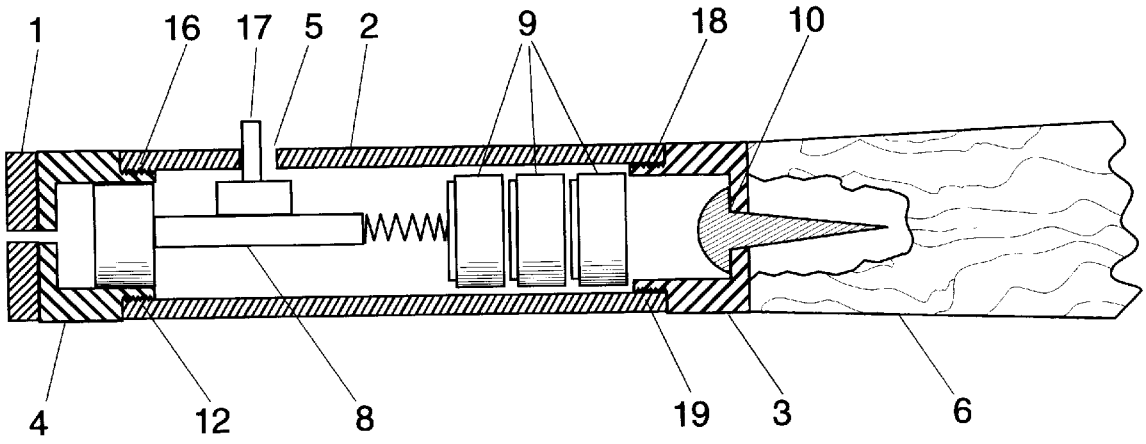
FIG. 3 is a longitudinal view in section in an enlarged scale of FIG. 1.
Figure 4:
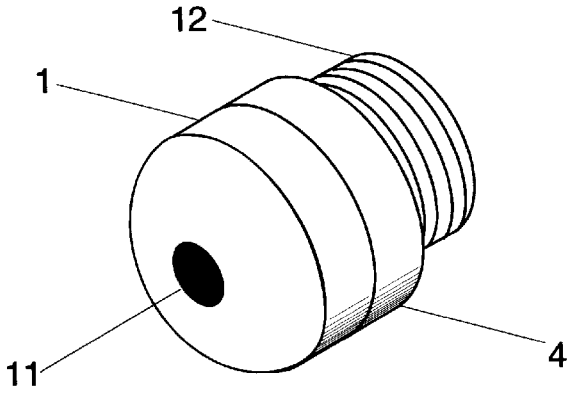
FIG. 4 is an elevational assembly view of the cue tip assembly of the english and trajectory assistant shown in FIG. 2.
Figure 5:
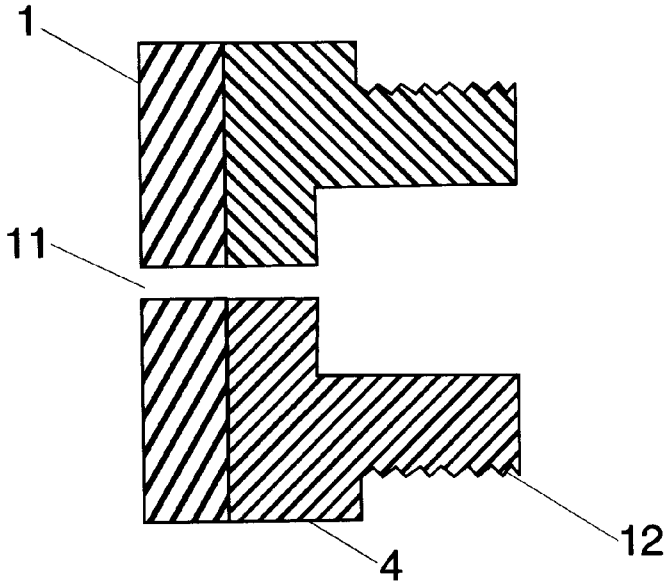
FIG. 5 is a sectional view in an enlarged scale of the cue tip assembly of the english and trajectory assistant shown in FIG. 2.

Referring now to FIGS. 1–5, an english and trajectory assistant is generally comprised of a billiard cue tip 1, a front end cap 4, a casing 2, and a rear end cap 3. The casing 2 having a transverse hole 5 at a suitable location, inner threads 16 at the front end, and inner threads 18 at the rear end. The laser module 8, the battery set 9, and the pan head wood screw 10 are respectively mounted within the casing 2. The slide switch 17 is mounted on the laser module 8 so as to be accessed through the hole 5 of casing 2. The billiard cue tip 1 is glued in the normal fashion to the front end cap 4, creating a cue tip assembly 7. Said front end cap 4 having outer threads 12 is threaded into the inner threads 16 of the casing 2. The rear end cap 3 is fastened to a cue stick 6 by means of a pan head wood screw 10. Said rear end cap 3 having outer threads 19 is threaded into the inner threads 18 of casing 2. When assembled, the slide switch 17 causes the battery power supply of the battery set 9 to be transmitted to the laser module 8, thereby triggering the laser module 8 to emit a laser beam through the hole 11 in front end cap 4 and billiard cue tip 1.

Figure 6:
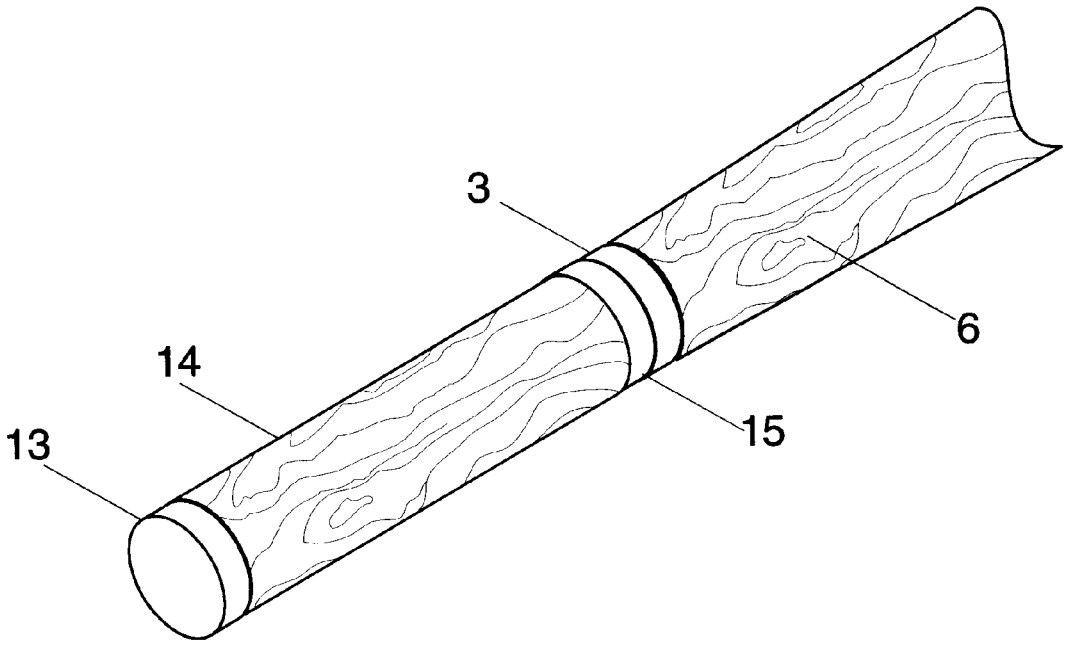
FIG. 6 is an elevational view of the attachable traditional cue end.
Figure 7:
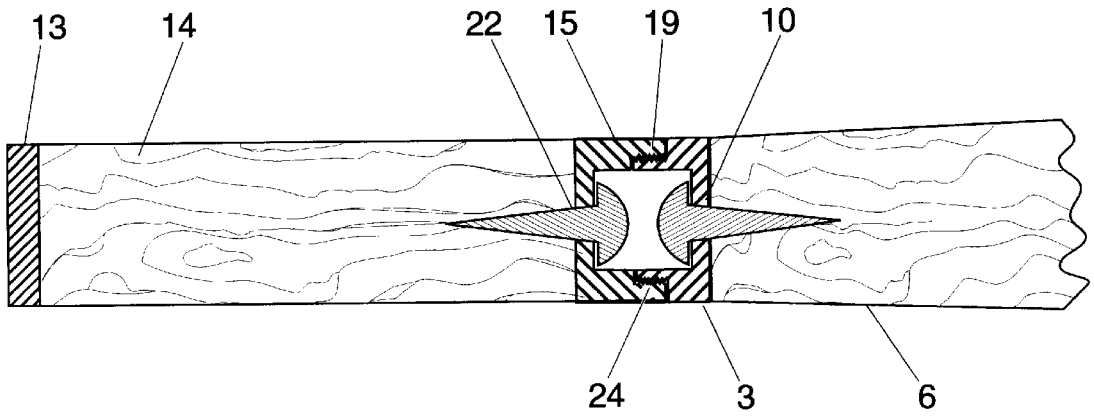
FIG. 7 is a longitudinal view in section in an enlarged scale of FIG. 6.

FIGS. 6 and 7 show an attachable traditional cue end 14 which, at the option of the user, can be utilized as an alternative to the english and trajectory assistant. Billiard cue tip 13 is glued to the wooden traditional cue end 14 in the normal fashion. End cap 15 having inner threads 24 is attached to the traditional cue end 14 by means of a pan head wood screw 22. The inner threads of end cap 15 are threaded over the outer threads 19 of rear end cap 3. It is understood that in some cases the user may not wish to utilize the english and trajectory assistant and instead use the attachable traditional cue end 14.

Figure 8:
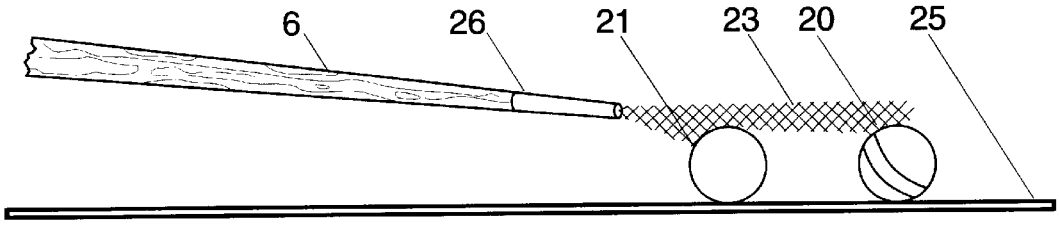
FIG. 8 is a side view of the english and trajectory assistant in an in use position.
Figure 9:
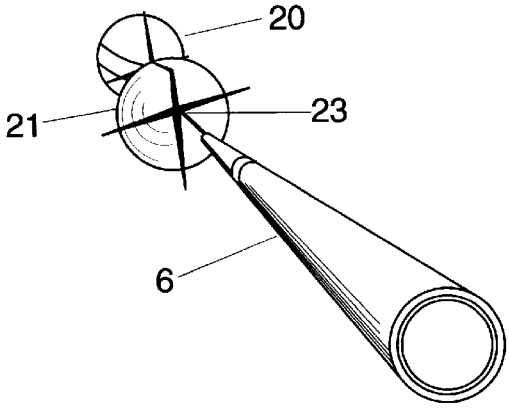
FIG. 9 is a rear view of the english and trajectory assistant in an in use position.

FIGS. 8 and 9 show the present invention in use, assembled and energized. The english and trajectory assistant 26 has been installed on a user's cue stick 6. A laser beam 23 having, in the preferred embodiment, the projected shape of cross hairs, is projected simultaneously upon the cue ball 21 and target ball 20, resting on billiard table 25. The vertical line segment of laser beam 23 allows the player to align the cue stick 6 so that when striking the cue ball 21, said cue ball 21 will travel toward target ball 20 and strike said target ball 20 at the point illuminated by the laser beam 23. If the point on the target ball 20 is not the point which the player wishes the cue ball 21 to strike, the player can adjust cue stick 6 until laser beam 23 illuminates the surface of target ball 20 at the desired point of impact.

The cross hairs of the laser beam 23 in the preferred embodiment illuminates the exact point on cue ball 21 at which the cue stick 6 will strike. This allows the player to select and visualize the impact point which will determine the english applied to the cue ball 21.

Those skilled in the art will now see that an english and trajectory assistant has been described that is manufacturer- or user-attachable to their desired cue stick. The present invention allows a player to visualize the trajectory the cue ball will take, and the point affecting the applied english. The laser beam, projected collinear with the cue stick, will not change position as the cue stick is urged toward the cue ball. The present invention does not require the player to move the stick from an aiming position to a shooting position: these are one in the same. The consumable parts, namely the battery set and the billiard cue tip, are easily replaceable. The present invention does not cause the integrity of the pool stick to suffer from imbalance or awkward shape changes. As a result of the sustained-contact switch, the player is not required to hold a button while shooting, which might detrimentally affect his performance. The invention also allows for "traditional" unaided play by switching the english and trajectory assistant off or by replacing it altogether with the optional, attachable traditional cue end.

The present invention has been described here in one specific embodiment. Many modifications, alterations, changes, and substitutions are possible arid permissible while keeping within the scope and the spirit of the invention. The embodiment depicted here has been for illustrative purposes only, while the spirit and scope of the invention are defined by the following claims.

I claim as my invention:

1. An english and trajectory assistant, said assistant comprising:

a casing having a front end and rear end;

a projector of light contained in said casing;

an aperture in said casing allowing light to exit;

a means for easily attaching and removing said casing to an existing pool cue;

a removable cue tip for easy replacement;

a sustained-contact switch to maintain power to the light projector.

2. The assistant of claim 1 wherein said casing is of the same weight and shape as a cue portion of the same length.

3. The assistant of claim 1 wherein said casing is adapted to unscrew from the cue.

4. The assistant of claim 1 wherein said light projector generates a cross hairs pattern.

5. The assistant of claim 1 wherein said light projector is a lightwave amplification by stimulated emission of radiation module.

6. The assistant of claim 1 wherein said light projector is a light emitting diode.

7. The assistant of claim 1 wherein said removable cue tip is threaded into said casing.

8. The assistant of claim 1 wherein said sustained-contact switch is a slide switch.

9. The assistant of claim 1 wherein said sustained-contact switch is a pushbutton.

10. The assistant of claim 1 wherein said sustained-contact switch is a toggle switch.

11. The assistant of claim 1 wherein said projector of light is powered by a battery set.

12. The assistant of claim 1 wherein said projector of light is powered by a rechargeable battery set.

13. The assistant of claim 1 wherein the user can change and select the shape of the pattern generated by said light projector.

14. The assistant of claim 1 wherein the assistant is attached to a cue.

* * * * *